US007483666B2

(12) United States Patent
Tatematsu et al.

(10) Patent No.: US 7,483,666 B2
(45) Date of Patent: Jan. 27, 2009

(54) FIXING APPARATUS AND IMAGE FORMING APPARATUS

(75) Inventors: Hideki Tatematsu, Hyogo (JP); Noboru Katakabe, Kyoto (JP); Shigemitsu Tani, Osaka (JP); Yuichi Hatase, Fukuoka (JP)

(73) Assignee: Panasonic Corporation, Osaka (JP)

( * ) Notice: Subject to any disclaimer, the term of this patent is extended or adjusted under 35 U.S.C. 154(b) by 288 days.

(21) Appl. No.: 11/566,394

(22) Filed: Dec. 4, 2006

(65) Prior Publication Data

US 2007/0127959 A1 Jun. 7, 2007

(30) Foreign Application Priority Data

Dec. 5, 2005 (JP) ..... 2005-350373

(51) Int. Cl.
*G03G 15/20* (2006.01)
*H05B 1/00* (2006.01)

(52) U.S. Cl. ..... 399/329; 219/619; 399/333

(58) Field of Classification Search ..... 219/216, 219/619; 399/320, 328, 329, 333
See application file for complete search history.

(56) References Cited

U.S. PATENT DOCUMENTS

| | | | | |
|---|---|---|---|---|
| 6,888,113 | B2 | 5/2005 | Monda et al. | |
| 7,079,800 | B2 | 7/2006 | Asakura et al. | |
| 7,379,287 | B2 * | 5/2008 | Fujimoto | 361/267 |
| 7,383,010 | B2 * | 6/2008 | Isayama et al. | 399/329 |
| 2005/0041991 | A1 | 2/2005 | Ihara et al. | |
| 2006/0251440 | A1 | 11/2006 | Tatematsu et al. | |
| 2007/0014601 | A1 | 1/2007 | Yasuda et al. | |

FOREIGN PATENT DOCUMENTS

JP 2001-125407 5/2001

OTHER PUBLICATIONS

English language Abstract of JP 2001-125407.

* cited by examiner

*Primary Examiner*—Hoang Ngo
(74) *Attorney, Agent, or Firm*—Greenblum & Bernstein, P.L.C.

(57) ABSTRACT

A shield plate that has a plate portion stretching in a width direction of exciting coils is positioned so that end portions of the shield plate oppose the exciting coils. The present invention prevents elongated warm-up time and reduces a dramatic temperature drop when printing on thick paper in a low temperature environment.

20 Claims, 16 Drawing Sheets

FIXING APPARATUS AND IMAGE FORMING APPARATUS

BACKGROUND OF THE INVENTION

1. Field of the Invention

The present invention relates to a fixing apparatus and an image forming apparatus that uses the same. The fixing apparatus is used in image forming apparatuses such as copiers, facsimile machines, and printers that employ an electro-photography or electro-static recording method. Especially, the present invention is related to the fixing apparatus that heats and fixes an unfixed image on recording material using an electromagnetic-induction heating method.

2. Description of Related Art

In recent years, there have been many researches performed on employing an electromagnetic-induction heating method for fixing apparatuses used in apparatuses such as copiers, facsimile machines, and printers. In such a fixing apparatus that employs the electromagnetic-induction heating method, an alternating current is applied to an exciting coil around which an alternating magnetic flux is generated. When the generated alternating magnetic flux permeates through a conductor, an eddy current (EC) is generated. Heat in the conductor caused by the EC is used for fixing an un-fixed image.

At the same time, many attempts have been made to shorten a warm-up period of the fixing apparatus, by decreasing, as much as possible, heat capacity for the heated portion of the fixing apparatus, and by strengthening thermal insulation. However, there are shortcomings, caused by decreasing the heat capacity of the heating unit and strengthening the thermal insulation, that the heat does not properly transfer in the width direction. Especially when narrow-width recording material is continuously fixed, temperature outside the recording material width abnormally rises, thereby causing hot offset, damaging and lowering life of a rubber member. In Related Art 1, as shown in FIG. 14, an attempt has been made to provide arch shaped conductive member 45*a* as a means for preventing excessive temperature of the heating roller 44 rising outside the recording material width. Conductive member 45*a* is located inside heating roller 44, which is heated with exciting coil 23, and directly facing the inner surface of heating roller 44.

[Related Art 1] Japanese Patent Laid-Open Publication 2001-125407

Nonetheless, conductive member 45*a* for shielding the magnetic flux has an arch shape facing to the inner surface of heating roller 44, and is disposed proximate to heating roller 44. Accordingly, during the warm-up period, the temperature rises as heating roller 44 is heated, and when a difference in temperature increases between heating roller 44 and conductive member 45*a*, conductive member 45*a* also raises its temperature as it receives radiated heat from heating roller 44 and heat conductance through air. At this time, conductive member 45*a* has an arch shape and has a large surface that faces to the inner surface of heating roller 44. Since conductive member 45*a* has a relatively large shape and large heat capacity, there is a high heat transfer from heating roller 44. Therefore, when the temperature of heating roller 44 and fixing belt 20 exceeds approximately 150° C., the heat rising speed slows down and the warm-up period thus becomes long. When the heat capacity is large, the heat in heating roller 44 continues to escape to conductive member 45*a* even after the temperature rises to the fixing temperature. Therefore, when the fixing of the recording material is continuously performed right after the temperature rise, quantity of heat to be provided becomes insufficient because the quantity of heat escapes to not only conductive member 45*a* but also the recording material, thereby lowering the temperature of heating roller 44 and fixing belt 20. This phenomenon is seen especially when the environmental temperature is low and thick recording paper is used for fixing. The temperature drop causes poor fixing quality. In order to prevent this problem, it is necessary to wait, prior to start fixing, for the temperature of conductive. member 45*a* to rise to a predetermined temperature. As a result, the warm-up period becomes long.

SUMMARY OF THE INVENTION

The present invention is provided to address the above-described problem. A purpose of the invention is to provide a fixing apparatus and an image forming apparatus that uses the same, the fixing apparatus utilizing an electromagnetic induction heating method and being configured with a conductive member appropriate for shielding a magnetic flux. The fixing apparatus therefore minimizes a warm-up period of the fixing apparatus, securely prevents excessive temperature rise, and provides a high-quality fixing performance.

In order to address the above-described problem, the present invention provides a fixing apparatus including: a heat generator including a magnetic material; an exciting coil that is positioned in proximity to the heat generator; a magnetic core that is positioned in proximity to the exciting coil; and a non-magnetic conductor that has a generally linear cross-sectional configuration, the non-magnetic conductor and the exciting coil being positioned on opposite sides of the heat generator. The conductor is located in magnetic field generated by the exciting coil and the magnetic core, a cross-section of the conductor including a central portion, and a portion projecting from a central portion, the projecting portion of the conductor extending towards the heat generator and having a surface extending transverse to a major surface of the central portion, the transversely extending surface facing the heat generator.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The embodiments of the present invention are explained in the following, in reference to the above-described drawings.

First Embodiment

Figure 1:
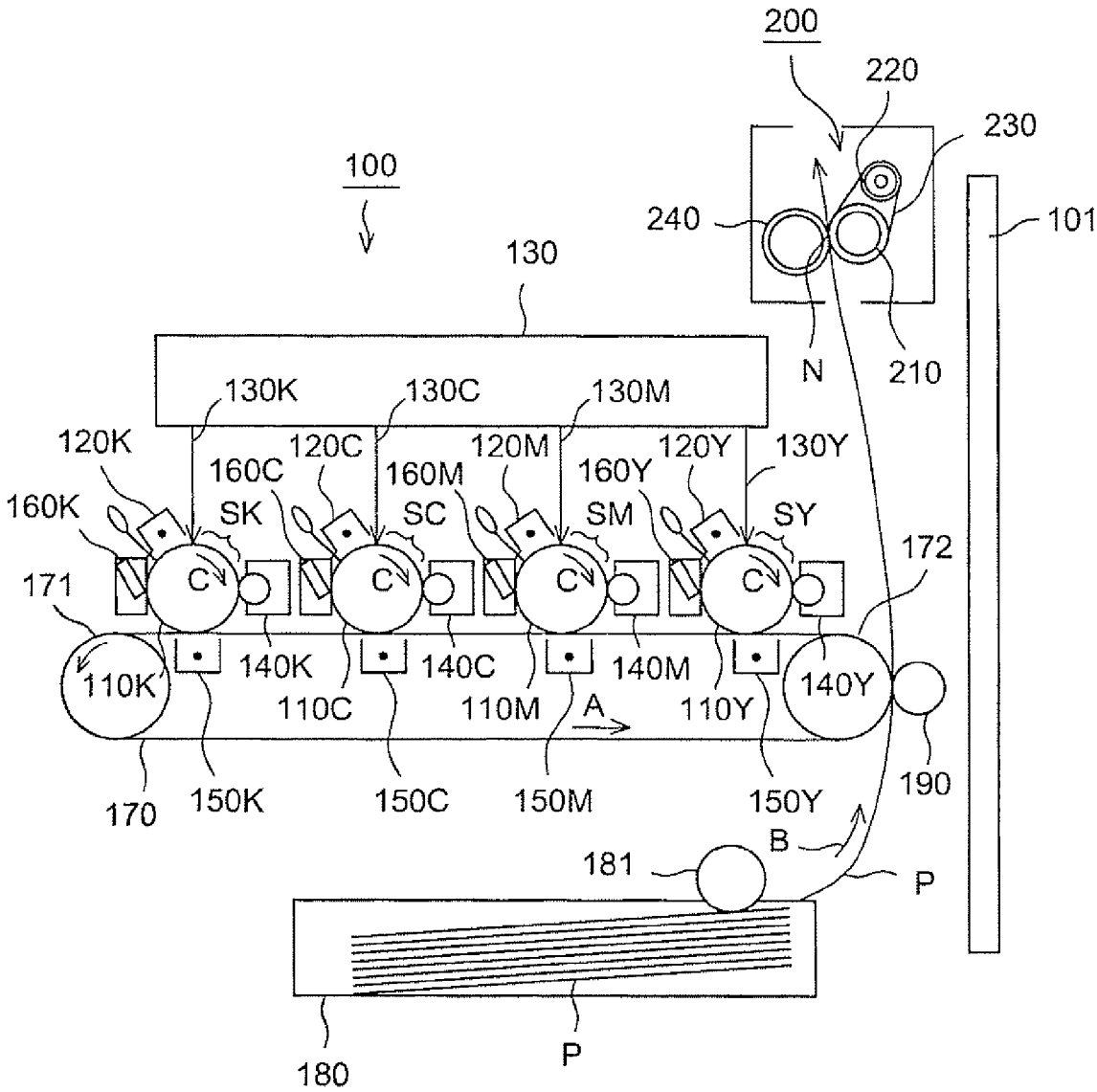
FIG. 1 is a schematic cross sectional view of an image forming apparatus according to the first embodiment of the present invention.

FIG. 1 is a schematic cross sectional view of an image forming apparatus that employs a fixing apparatus according to the first embodiment of the present invention. Image forming apparatus 100 is an image forming apparatus that employs a tandem method. In image forming apparatus 100, four different colors of toner images rendering a color image are separately formed on each of four image bearers. The toner images are primarily transferred in sequence overlapping each other on an intermediate transfer unit and the primary transfer image is then collectively transferred to a recording medium (secondary transfer).

Of course the fixing apparatus according to the first embodiment can be installed to any image forming apparatus, not limited to the image forming apparatus using the above-described tandem method.

In FIG. 1, symbols Y, M, C, and K at the ends of each numerical reference of the components of image forming apparatus 100 indicate that each component is related to image formation of Y: yellow image; M: magenta image; C: cyan image; and K: black image. Components having the same numerical reference have the same configuration.

Image forming apparatus 100 has photoconductive drums 110Y, 110M, 110C, and 110K as the above-mentioned four image bearers, and intermediate transfer belt (intermediate transferee) 170. In the proximity of each of photoconductive drums 110Y, 110M, 110C, and 110K, respective image forming stations SY, SM, SC, and SK are located. Image forming stations SY, SM, SC, and SK are respectively configured with: chargers 120Y, 120M, 120C, and 120K; exposure apparatus 130; developers 140Y, 140M, 140C, and 140K; transferers 150Y, 150M, 150C, and 150K; and cleaning apparatuses 160Y, 160M, 160C, and 160K.

In FIG. 1, each of photoconductive drums 110Y, 110M, 110C, and 110K is rotated in arrowed direction C. The surfaces of each of photoconductive drums 110Y, 110M, 110C, and 110K are evenly charged to a predetermined electric potential by respective chargers 120Y, 120M, 120C, and 120K.

The charged surfaces of each of photoconductive drums 110Y, 110M, 110C and 110K are irradiated, through exposure apparatus 130, with respective laser beams 130Y, 130M, 130C, and 130K, which correspond to image data having specific colors. Accordingly, electrostatic latent images for the specified colors are formed on the surfaces of each of photoconductive drums 110Y, 110M, 110C, and 110K respectively.

The electrostatic latent images for the specified colors formed on each of photoconductive drums 110Y, 110M, 110C, and 110K are then developed by developers 140Y, 140M, 140C, and 140K. Accordingly, four-color unfixed images rendering the color image are formed on photoconductive drums 110Y, 110M, 110C, and 110K.

The four-color toner images developed on photoconductive drums 110Y, 110M, 110C, and 110K are primarily transferred, by transferers 150Y, 150M, 150C, and 150K, to endless intermediate transfer belt 170 that acts as the intermediate transferee. Accordingly, four color toner images formed on photoconductive drums 110Y, 110M, 110C, and 110K are sequentially overlapped to form a full color image on intermediate transfer belt 170.

After the toner image is transferred to intermediate transfer belt 170, remaining toner left on each surface of photoconductive drums 110Y, 110M, 110C, and 110K is removed by respective cleaning apparatuses 160Y, 160M, 160C, and 160K.

Exposure apparatus 130 is disposed at a predetermined angle with respect to photoconductive drums 110Y, 110M, 110C, and 110K. In addition, intermediate transfer belt 170 is suspended by driving roller 171 and driven roller 172. When driving roller 171 rotates, intermediate transfer belt 170 turns to arrowed direction A as shown in FIG. 1.

Paper feeding cassette 180 that contains recording paper P (e.g., printing paper) as a recording medium is provided at the bottom of image forming apparatus 100. Each sheet of recording paper P is fed by paper feeding roller 181 from paper feeding cassette 180 through a predetermined sheet path, in arrowed direction B.

Recording paper P fed into the sheet path passes a transfer nip that is formed by an outside surface of intermediate transfer belt 170 suspended by driven roller 172, and secondary transfer roller 190 contacting the outside surface of intermediate transfer belt 170. The full color image (unfixed image) formed on intermediate transfer belt 170 is collectively transferred on recording paper P by secondary transfer roller 190, when recording paper P passes the transfer nip.

Then, recording paper P passes fixing nip N that is formed by an outside surface of fixing belt 230, which is suspended by fixing roller 210 and heating roller 220 of fixing apparatus 200, and pressure roller 240 contacting the external circumferential surface of fixing belt 230. Accordingly, the unfixed full color image collectively transferred by the transfer nip is fixed with heat on recording paper P.

In addition, door 101 that can freely be opened and closed is provided to image forming apparatus 100, as part of the case of image forming apparatus 100. By opening and closing door 101, it is possible to perform procedures such as replacing or conducting maintenance of fixing apparatus 200 and removing recording paper P jammed on the paper delivery path.

Figure 2:
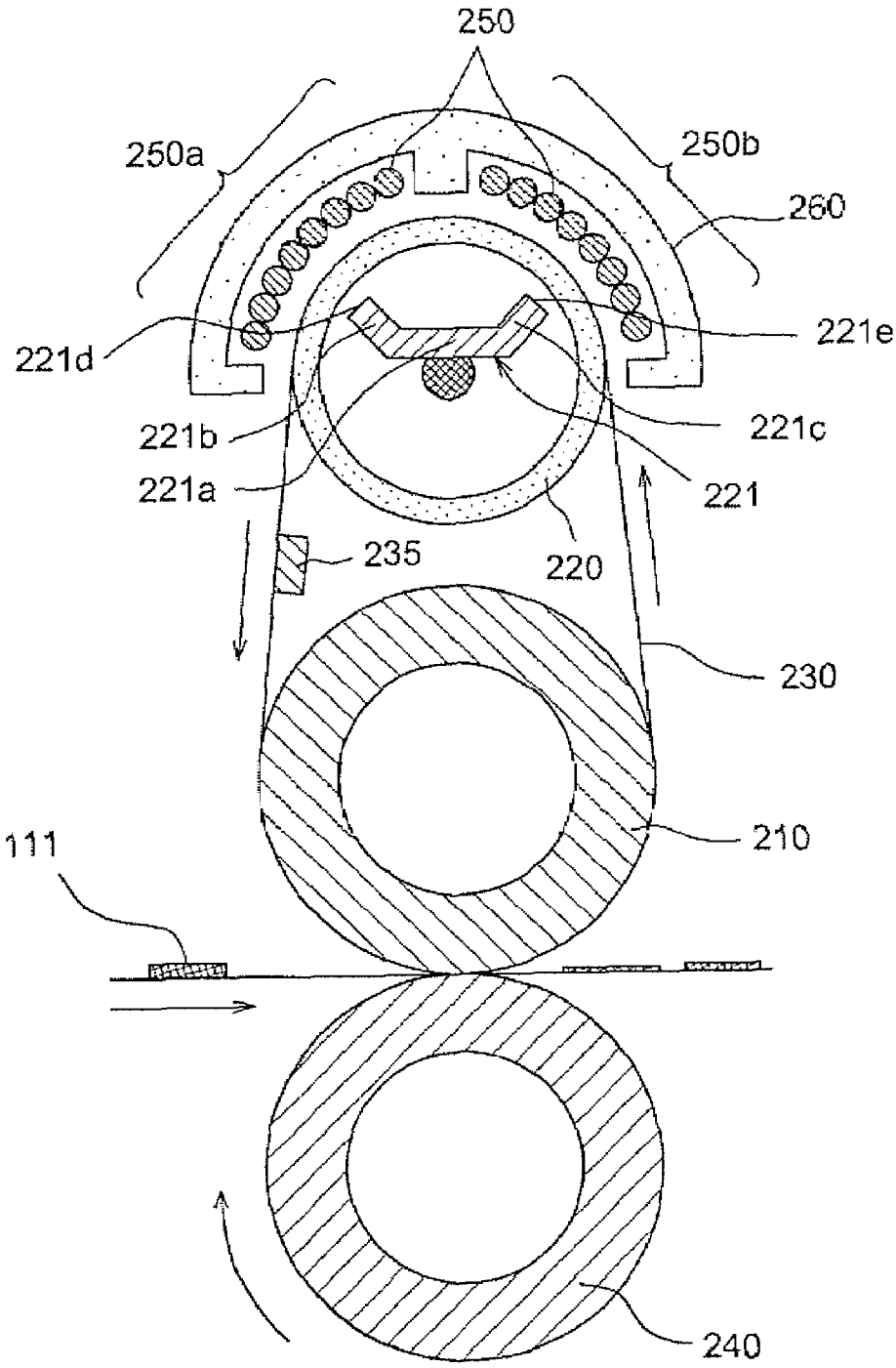
FIG. 2 is a schematic cross sectional view of a fixing apparatus according to the first embodiment of the present invention.
Figure 3:
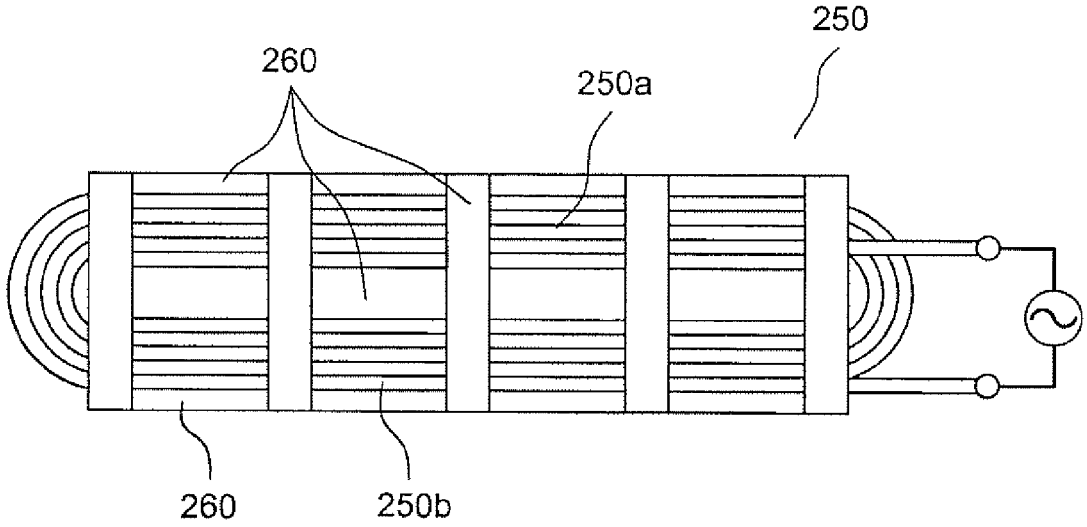
FIG. 3 illustrates a fixing apparatus according to the first embodiment of the present invention.

The following describes the fixing apparatus installed in image forming apparatus 100. FIG. 2 is a schematic cross sectional view of fixing apparatus 200 according to the first embodiment of the present invention. FIG.3 also illustrates fixing apparatus 200 according to the first embodiment of the present invention.

Fixing belt 230 is suspended, with a predetermined tension level, between fixing roller 210 and heating roller 220, fixing roller 210 including a surface configured with foaming silicone rubber having elasticity of low-degree hardness (JISA 30 degrees) with a diameter of 34 mm, and having low thermal conductivity, heating roller 220 being a later-described alloy with a diameter of 20 mm. Fixing belt 230 can be rotated in the arrowed direction. Heating roller 220 is configured with a magnetic metal, an alloy of iron and nickel, having a thickness of 0.2 mm. The alloy is manufactured so that the ratio of iron-nickel composition is adjusted to achieve the magnetism-to-temperature characteristics shown in FIG. 4 (the magnetic alloy of the present embodiment has about 30% of the nickel ratio).

Inside heating roller 220, shielding plate 221 is provided in the approximately entire width of the heating roller and facing heating roller 220. Shielding plate 221 has a plate shape and configured with a conductive member such as aluminum and copper. Shielding plate 221 has central portion 221*a* that has a flat shape and a pair of bent portions 221*b* and 221*c* that are provided at an angle from both ends of central portion 221*a*. The distance between shielding plate 221 and heating roller 220 varies, according to positions in a circumferential direction of heating roller 220. In other words, the distance between an end surface 221*d* of bent portion 221*b* and heating roller 220 (the distance between an end surface 221*e* of bent portion 221*c* and heating roller 220) is shorter than between central portion 221*a* of shielding plate 221 and heating roller 220.

Further, the end surfaces 221*d* and 221*e* of bent portions 221*b* and 221*c* are disposed closest to heating roller 220, thereby having the shortest distance between shielding plate 221 and heating roller 220. More specifically, end surface 221*d* faces heating roller 220 at a central region of left portion 205*a* of clustered exciting coil 250, and distance of end surface 221*d* to heating roller 220 is approximately 0.5 mm. Similarly, end surface 221*e* faces heating roller 220 at central region of right portion 205*b* of clustered exciting coil 250, and distance of end surface 221*e* to heating roller 220 is approximately 0.5 mm.

In FIG. 2, pressure roller 240 is configured with silicon rubber having a hardness of JISA 65 degrees and presses fixing roller 210 through fixing belt 230, as shown in FIG. 2, to form a nip. Pressure roller 240 is rotatably driven in the arrowed direction by a driver (not shown) of the main apparatus. The rotation of pressure roller 240 is followed by fixing belt 230, fixing roller 210, and heating roller 220, thereby performing a fixing operation. In addition, exciting coils 250 and shielding plate 221 can be configured to be at fixed locations. When there is no need to have a magnetic shielding operation, They can configured to be inverted at 180 degrees, when there is no need to have a magnetic shielding operation.

Pressure roller 240 can be configured with other heat resistant resin and rubber such as fluoric rubber and fluoric resin. In order to increase anti-wear performance and releasability, coating can be made, on the surface of pressure roller 240, by singular or mixture use of resin and rubber such as PFA, PTFE, and FEP. In order to prevent heat dissipation, it is preferable that pressure roller 240 is configured with material having small heat conductivity.

Temperature sensor 235 is located approximately in the center of a width direction of fixing belt 230 and on a fixing nip entering side. Temperature sensor 235 detects temperature of fixing belt 230 so as to control temperature of paper passage section at a predetermined constant temperature through a control circuit (not shown).

Exciting coil 250 is configured with fluxes of litz wires and has a shape, in a cross sectional view, that covers a contact area of fixing belt 230 and heating roller 220 as shown in FIG. 2. Padding member 260 configured with ferrite is provided in the central and rear area of exciting coil 250. Padding member 260 can be configured with material having high magnetic permeability such as perm alloy. Approximately 1200 W max of AC power at 20-60 kHz is applied to exciting coils 250 from an exciting circuit.

Figure 4:
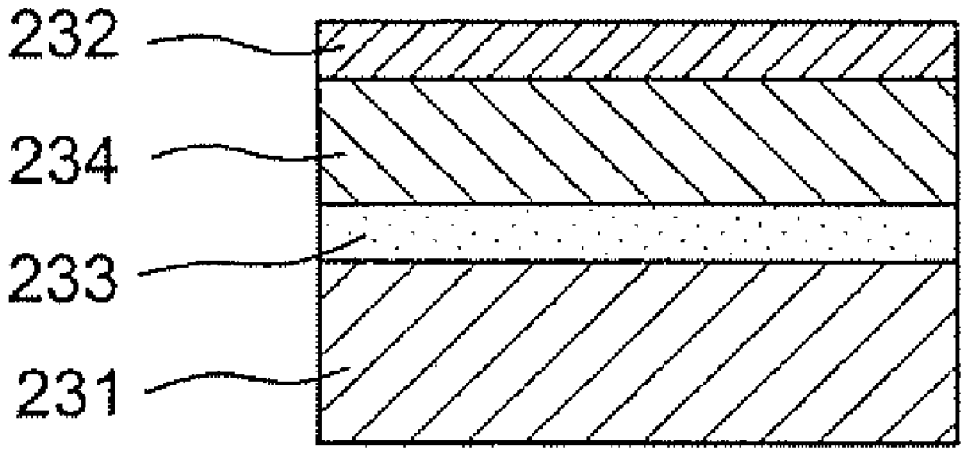
FIG. 4 is a schematic cross sectional view of a fixing belt according to the first embodiment of the present invention.

FIG. 4 illustrates a cross sectional view of thin fixing belt 230. Fixing belt 230 includes base member 231, conductive layer 233, elastic layer 234 and releasing layer 232. Base member 231 is an endless belt configured with polyimide resin and for A3 size recording having approximately 340 mm for width, 47 mm for diameter, and 70 μm for thickness. As shown in the cross sectional view in FIG. 4, conductive layer 233 is formed on base member 231 as a layer that generates heat through an electromagnetic inductance and is made from a copper material having a thickness of approximately 10 μm. Elastic layer 234 is formed on conductive layer 233. Releasing layer 232 coated on the surface of elastic layer 234 is a fluoric resin to enhance releasability from a toner image and has a thickness of 25 μm. In addition, conductive layer 233 can be formed by applying dispersing low-resistant pulverized material, such as silver, on the resin base member, Base member 231 can be of material such as an extremely thin electrocast metal, e.g., nickel having a thickness of approximately 40 μm. In this case, since nickel has a function to generate heat, the above-mentioned conductive layer 233 is not necessary. As for the metal base member, iron, stainless member, cobalt-nickel alloy, iron-nickel alloy are available. However, in case of non-magnetic SUS member, conductive layer 233 being made from a copper material should be formed as described above.

On the surface of releasing layer 232, singular or mixture of resin and rubber having good releasability, such as PTFE, PFA, FEP, silicone rubber, and fluoric rubber can be coated. When fixing monochrome images, only releasability needs to be secured. When fixing color images, however, it is preferable to also attain elasticity. In such a case, it is needed to form elastic layer 234, a rubber layer having a thickness of 50-300 μm being made of heat resistant rubber such as silicone rubber and fluoric rubber.

Although the fixing belt in the present invention includes conductive layer 233, it is possible to employ a configuration that does not include a conductive layer 233 when the heat efficiency is slightly lowered.

In the present embodiment, the configuration of the heating roller has temperature self-control characteristics. The function of the same is illustrated in the following, with reference to FIGS. 5 and 6(*a*) and (*b*).

Figure 5:
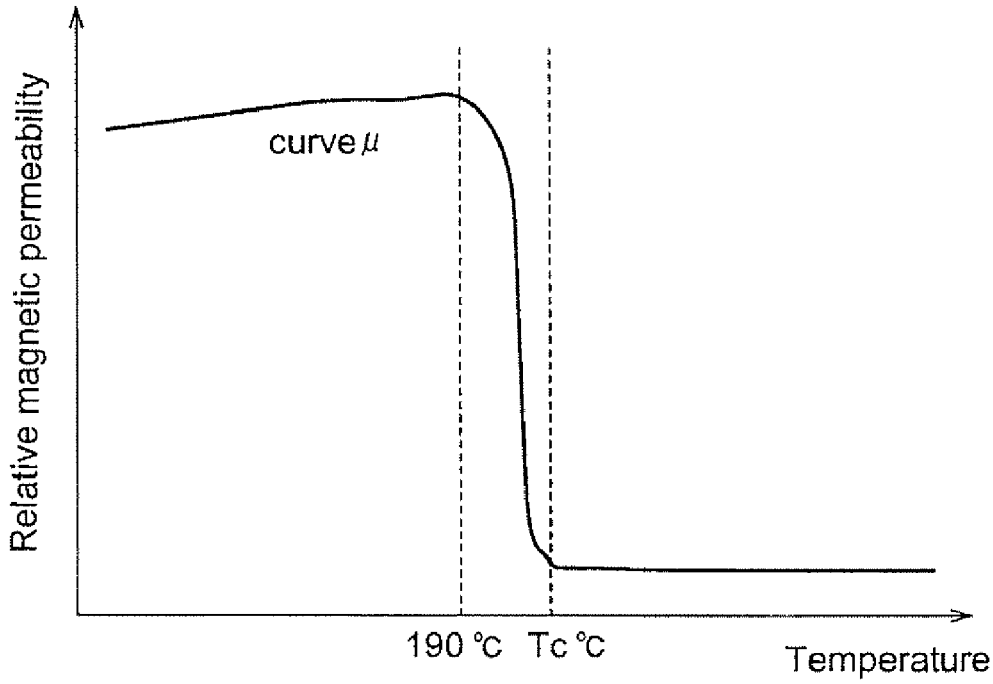
FIG. 5 illustrates a relationship between magnetic permeability and temperature of a heating roller used for the fixing apparatus according to the first embodiment of the present invention.

In FIG. 5, the horizontal axis represents temperature of heating roller 220 and the vertical axis represents relative magnetic permeability. Curved line μ illustrates the change of the relative magnetic permeability when the temperature of heating roller 220 is raised. In the figure, Tc illustrates Curie temperature, above which the magnetic permeability becomes practically the same as the one in the air, thereby starting a non-magnetic state. When the temperature of heating roller 220 is low, the relative magnetic permeability is high, while when the temperature rises and approaches the Curie point, the relative magnetic permeability is suddenly lowered.

Figure 6A:
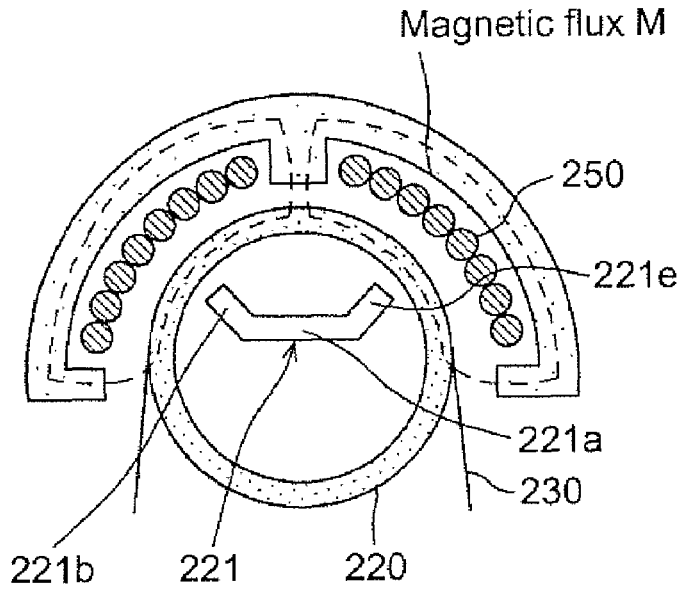
FIGS. 6(*a*) and 6(*b*) illustrate a flow of a magnetic flux during a low and high temperature periods of the heating roller used for the fixing apparatus according to the first embodiment of the present invention.
Figure 6B:
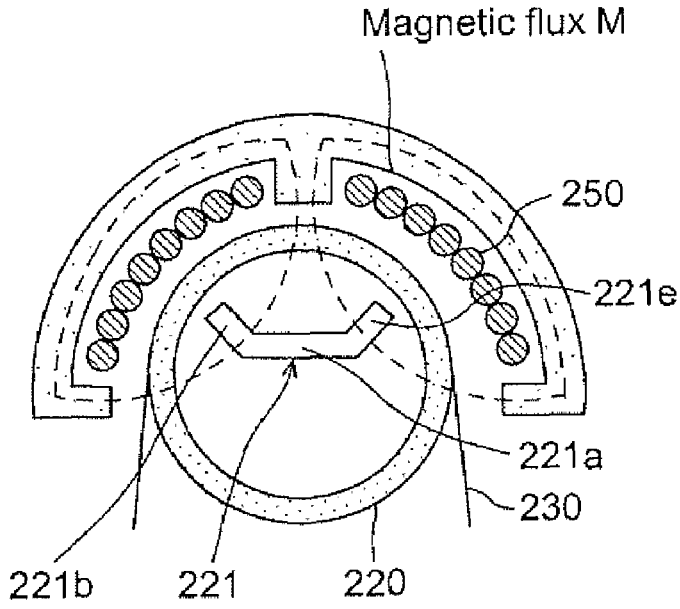

FIG. 6(*a*) illustrates a magnetic path of magnetic flux M, generated by exciting coils 250 when the magnetic metal of heating roller 220 is in a strong magnetic state under the Curie temperature. FIG. 6(*b*) illustrates a main magnetic path of magnetic flux M, when the magnetic metal of heating roller 220 is in a non-magnetic state over the Curie temperature.

When heating roller 220 is in a strong magnetic state, magnetic flux M that permeates fixing belt 230 and reaches heating roller 220, passes through heating roller 220 and surrounds exciting coils 250. Therefore, heating roller 220 is rapidly heated by Joule heat caused by inductive current flowing through heating roller 220. When heating roller 220 is heated passed the Curie temperature and becomes non-magnetic, magnetic flux M permeates heating roller 220, enters inside the roller, as shown in FIG. 6(*b*), and permeates shielding plate 221 to form a magnetic path that circulates around exciting coils 250. At this time, the main magnetic path for magnetic flux M (location where the magnetic strength is at the highest) does not include the center of shielding plate 221, but includes each of bent portions 221*b* and 221*c* at both ends of shielding plate 221. Therefore, magnetic flux M permeates bent portions 221*b* and 221*c*. Therefore, most of the inductive current flows in shielding plate 221, not heating roller 220.

In the configuration of the present embodiment, conductive layer 233 is formed within fixing belt 230. However, even when a belt is used without a conductive layer, it does not affect the above-described temperature self-control characteristics.

When recording paper P having the minimum width is inserted from image forming apparatus 100 to fixing apparatus 200 with the above-described configuration in order to continuously fix toner image 111, heating roller 220 generates heat according to the heat quantity taken by recording paper P. Therefore, within the width passed by recording paper P, the fixing temperature is maintained. However, because heat generated on outside ends of paper width of recording paper P is not taken by recording paper P, the temperature in the area continues to rise. When the temperature of heating roller 220 ends reaches the Curie point of heating roller 220, the heating roller loses its magnetic characteristics, and the inductive current flows on shielding plate 221. At this time, due to the current that flows through shielding plate 221, a magnetic flux having the reverse direction from the one generated from exciting coil 250 is generated. Therefore, the magnetic flux of exciting coil 250 is cancelled. Accordingly, the rising temperature of the end portion of heating roller 220 does not pass the Curie point and becomes saturated at a predetermined temperature close to the Curie point. This effect is obtained regardless of the width of recording paper P. Therefore, heating roller 220 can maintain its fixing temperature within the recording paper passage width, regardless of the width of the recording paper. At the same time, the outside end portion of the paper width can exhibit temperature self-control characteristics that maintain its temperature at a predetermined temperature close to the Curie point.

Figure 7:
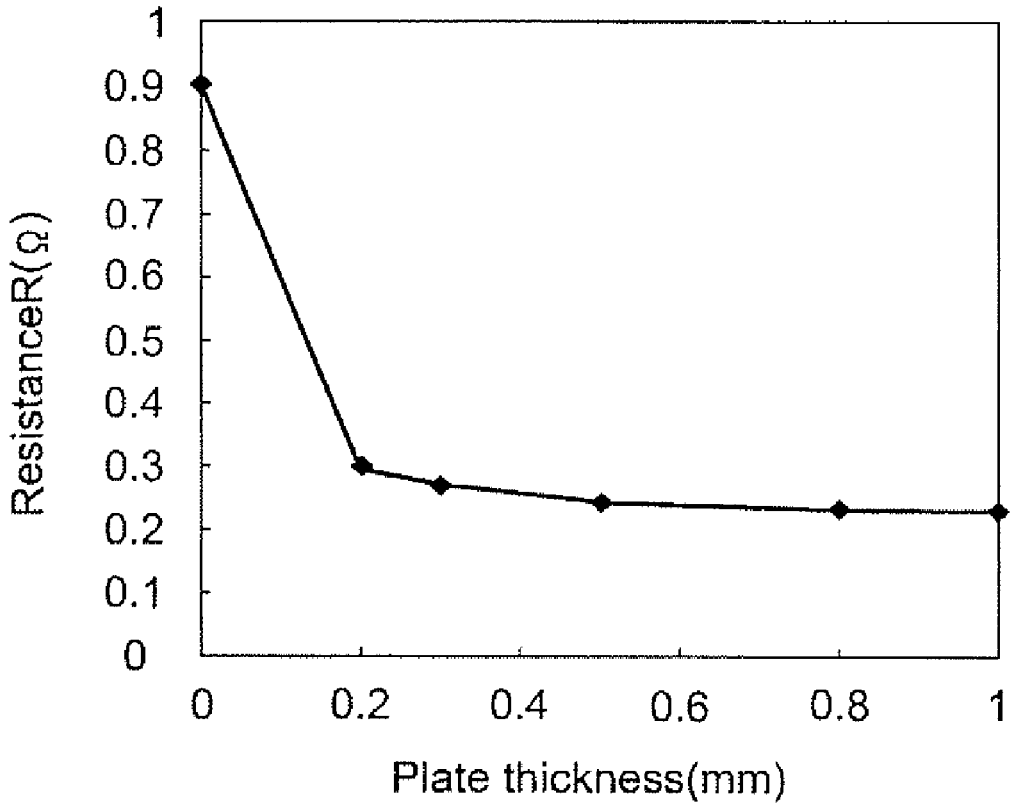
FIG. 7 illustrates a relationship between plate thickness of a shielding plate and resistance of an equivalent circuit in the fixing apparatus according to the first embodiment of the present invention.

It is preferable that the plate thickness of shielding plate 221 is 0.2 mm or more and 2 mm or less. FIG. 7 illustrates resistance R of an equivalent circuit configured with heating roller 220 and exciting coil 250, when frequency of alternating current is 20 kHz and plate thickness of shielding plate 221 is varied. In this example, copper is used for shielding plate 221 and the resistance is illustrated when heating roller 220 is at a high temperature, close to the Curie point. Since it is preferable that the heat generation is suppressed when heating roller 220 is close to the Curie point, resistance R should be low. In FIG. 7, when shielding plate 221 does not exist (thickness of shielding plate 221 is "0"), resistance R is about 0.9Ω while when thickness of shielding plate 221 is 0.2 mm, resistance R suddenly decreases to about 0.3Ω. When the thickness is 0.2 mm or more, not much change is seen in resistance R.

When the thickness of shielding plate 221 is 0.2 mm or more, it is possible to suppress the heat generation at the high temperature close to the Curie temperature. When the heat capacity of heating roller 220 is large, more heat is taken from heating roller 220. Therefore, it is preferable that the thickness of shielding plate 221 is 2 mm or less.

Figure 8:
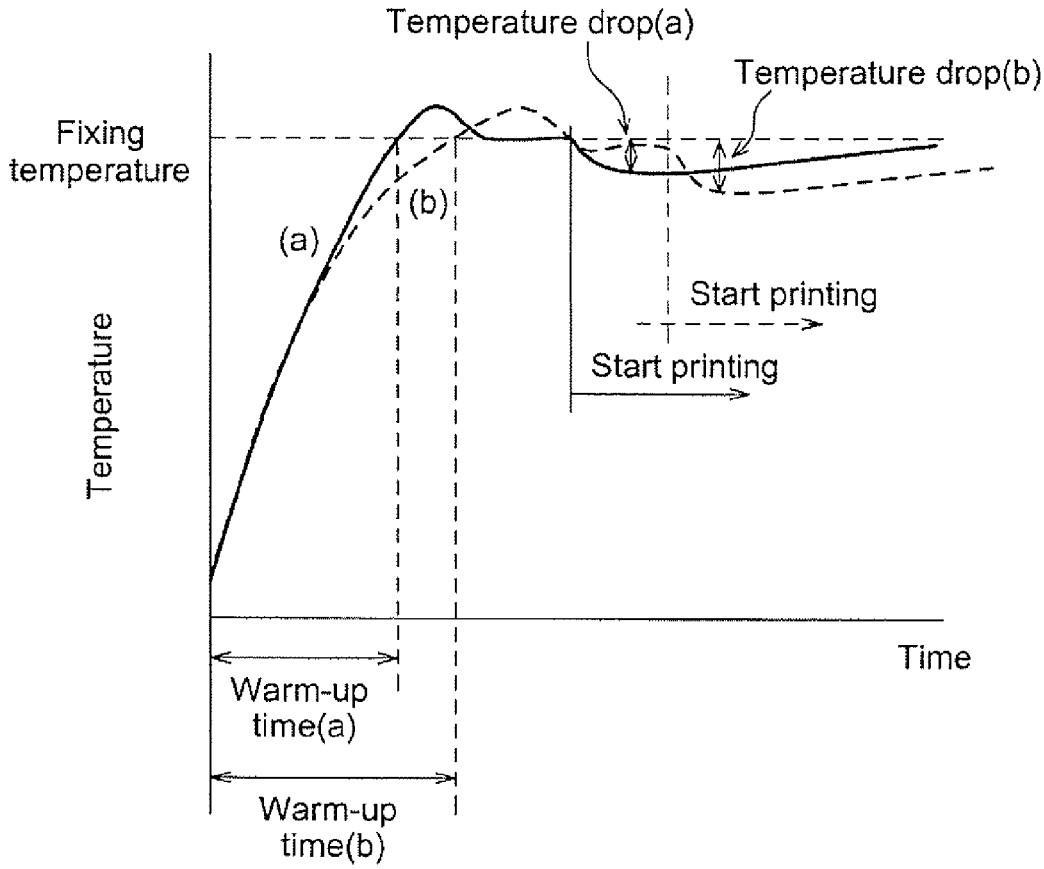
FIG. 8 illustrates belt temperature during warm-up and printing periods of the fixing apparatus according to the first embodiment of the present invention.

FIG. 8 illustrates belt temperature during warm-up and printing stages of the fixing apparatus (a) according to the present embodiment and prior art (b). In the fixing apparatus according to the present invention, end portions of shielding plate 221 (end surfaces 221*d* and 221*e* of bent portions 221*b* and 221*c*), being made of a plate, faces heating roller 220 in order to minimize areas that directly corresponds to the inner surface of heating roller 220. Accordingly, little heat is transferred from heating roller 220 by radiation and conduction. when the shield plate has a semicircular shape having a small gap formed to correspond to the heating roller, as shown in the prior art example FIG. 12, the warm-up period has been long because the heat from the heating roller escapes to the shield plate during the warm-up period of the fixing apparatus. Therefore, the prior art configuration slows the heat rising speed past 150° C. and elongates the warm-up period as shown in (b) in FIG. 8. Shielding plate 221 according to the present invention, however, has little portion that corresponds to the heating roller. Since only the end portions (end surfaces 221*b* and 221*c*) of the shield plate come close to the heating roller, the heat in the heating roller does not escape, thereby shortening the warm-up period. In the low temperature environment, during the printing stage immediately after the warm-up, the temperature of the heating roller can decrease without being able to maintain the fixing temperature. This temperature decrease is more dramatic when the heat capacity of the entire fixing apparatus (including pressure roller 240) is large. Therefore, when having a configuration where shielding plate 221 is close to heating roller 220, more heat escapes from heating roller 220 to shielding plate 221 during the low temperature of shielding plate 221, thereby increasing the amount of temperature drop. In the fixing apparatus according to the present invention, however, only the end portions of shielding plate 221 are close to the heating roller. Therefore, less heat escapes from heating roller 220 to shielding plate 221 and the amount of temperature drop is small.

Figure 9:
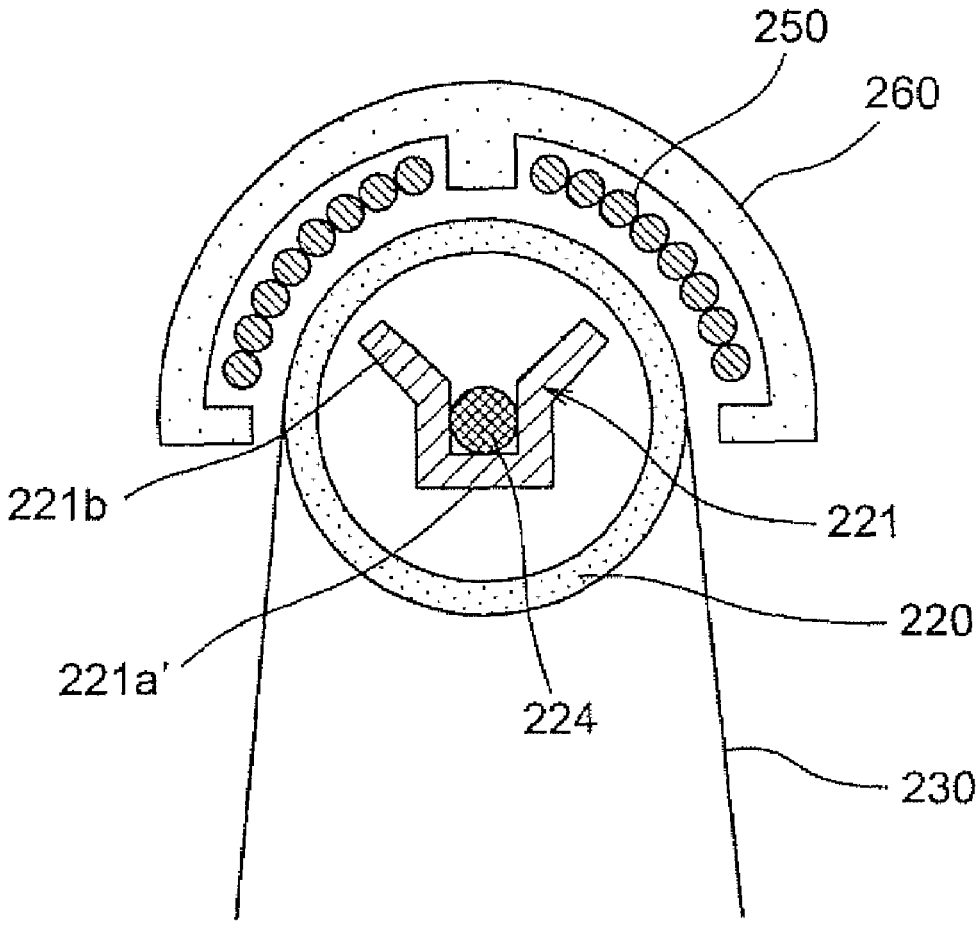
FIG. 9 is a schematic cross sectional view of another configuration according to the first embodiment of the present invention.
Figure 10:
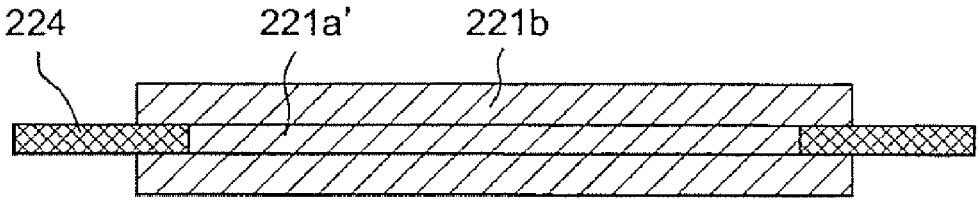
FIG. 10 illustrates the another configuration according to the first embodiment of the present invention.

FIGS. 9 and 10 illustrate other configurations of the shielding plate according to the first embodiment of the present invention. While shielding plate 221 of FIG. 2 has a plane central portion 221*a*, shielding plate 221 of FIGS. 9 and 10 have central portion 221*a*' having a reentrant-shape. By having such a reentrant-shape, shielding plate 221 itself is strengthened. As shown in FIG. 10, center shaft 224 can be supported only by both ends, and does not need to be at the entire length direction of shielding plate 221. Accordingly, the heat capacity of center shaft 224 can be lowered while maintaining the strength of shielding plate 221. Therefore, the temperature drop of heating roller 220 as described above becomes smaller, thereby shortening the warm-up period.

Second Embodiment

Figure 11:
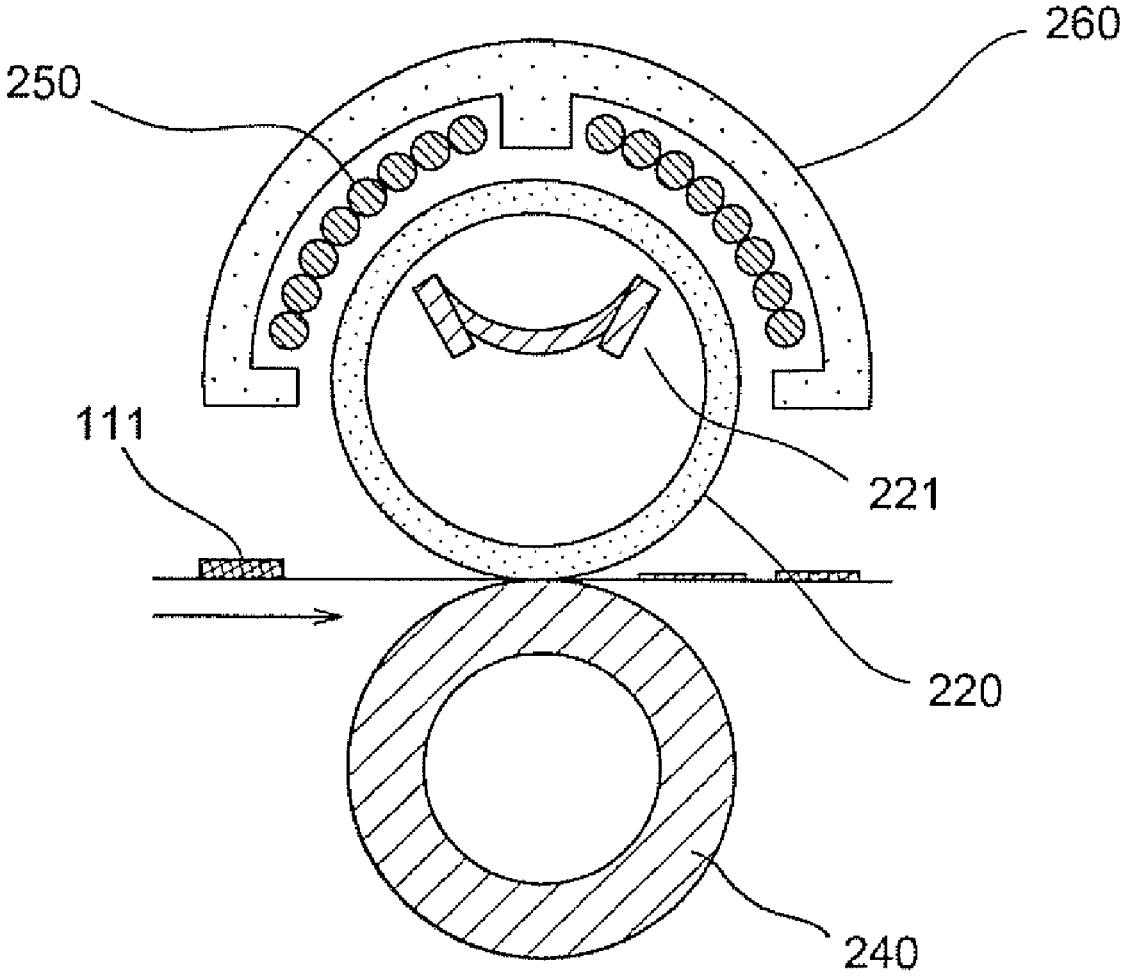
FIG. 11 is a schematic cross sectional view of a fixing apparatus according to the second embodiment of the present invention.

FIG. 11 is a schematic cross sectional view of a fixing apparatus according to the second embodiment of the present invention. In the second embodiment, components having the same configuration with the fixing apparatus according to the first embodiment have the same numerical references and their detailed descriptions are omitted.

In the second embodiment, fixing belt 230 and fixing roller 210 are eliminated from the first embodiment, and heating roller 220 directly melts toner 111 and fixes it on the recording paper. Other configurations are the same as the first embodiment. Heating roller 220 according to the second embodiment is made of a magnetic metal made from an iron-nickel alloy having a thickness of 0.4 mm and a diameter of 30 mm, A releasing layer is coated on the surface of heating roller 220 for its releasability, the layer being a fluoric resin of 15 μm thickness. As the releasing layer surface, singular or mixture of resin and rubber having good releasability, such as PTFE, PFA, FEP, silicone rubber, and fluoric rubber can be coated, The surface layer of pressure roller 240 is made of 5 mm sponge, in order to secure a sufficient nip even with a thin heating roller.

Shielding plate 221 according to the second embodiment has approximately an arch shape, and its end surfaces do not face heating roller 220. However, end portions that do not include the end surfaces face heating roller 220 and exciting coils 250. Shielding plate 221 according to the present embodiment is made of a plate member and its end portions are folded in. This configuration allows a more effective shielding of the magnetic flux.

The fixing apparatus according to the second embodiment has a temperature self-control function similar to the first embodiment. Compared to the first embodiment, the fixing apparatus according to the second embodiment has a smaller heat capacity for the entire fixing apparatus. In addition, shielding plate 221 of the present invention allows shorter warm-up period and smaller temperature drop during the low-temperature environment.

Third Embodiment

Figure 12:
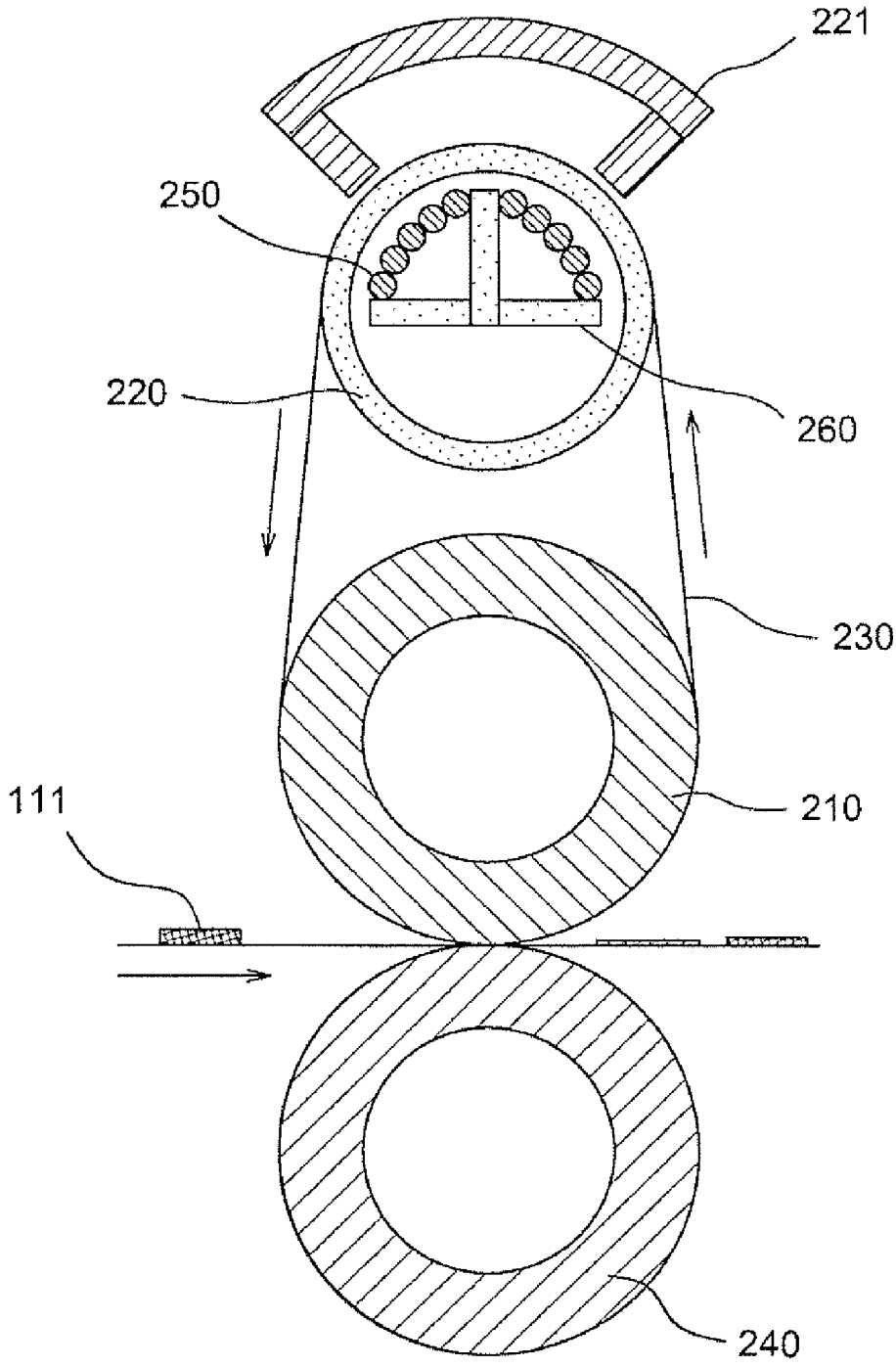
FIG. 12 is a schematic cross sectional view of a fixing apparatus according to the third embodiment of the present invention.

FIG. 12 is a schematic cross sectional view of a fixing apparatus according to the third embodiment of the present invention. In the third embodiment, components having the same configuration with the fixing apparatus according to the first embodiment have the same numerical references and their detailed descriptions are omitted.

In the third embodiment, exciting coil 250 and padding member 260 are enclosed within heating roller 220.

Shielding plate 221 is located outside of heating roller 220 and having a configuration that includes two rectangular plates that oppose exciting coil 250 and that are connected by a rear section. The portions opposing exciting coil 250 are end surfaces of shielding plate 221 and their thermal load in relation to heating roller 220 is very small. Although the rear section of shielding plate 221 corresponds to the heating roller, the rear section has a sufficient distance from heating roller 220 thus having a small thermal load, Therefore, shielding plate 221 not only corresponds to the heating roller, but its end portions oppose the heating roller. The end portions are connected at the rear, and their thermal load in relation to heating roller 220 is small, thereby shortening the warm-up period. In addition, the rear arched portion has an effect to dissipate self-generated heat created by shielding the magnetic flux.

Similar to the first embodiment, shielding plate 221 according to the present invention is provided close to heating roller 220 only at the end portions of shielding plate 221. Therefore, it is possible to shorten the warm-up period and decrease the temperature drop in the low temperature environment.

Fourth Embodiment

Figure 13:
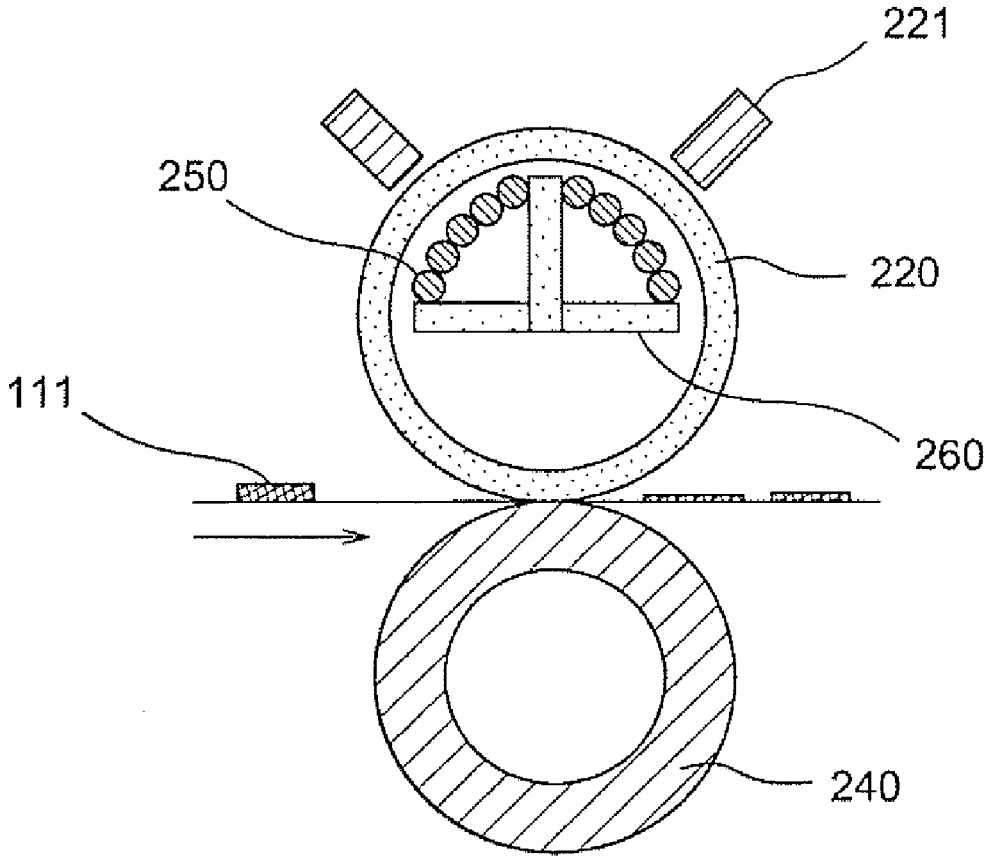
FIG. 13 is a schematic cross sectional view of a fixing apparatus according to the fourth embodiment of the present invention.

FIG. 13 is a schematic cross sectional view of a fixing apparatus according to the fourth embodiment of the present invention. In the fourth embodiment, components having the same configuration with the fixing apparatus according to the third embodiment have the same numerical references and their detailed descriptions are omitted.

In the fourth embodiment, fixing belt 230 and fixing roller 210 according to the third embodiment are eliminated. Heating roller 220 directly melts toner 111 and fixes it on the recording paper. Other configurations are the same as the second embodiment. Heating roller 220 according to the fourth embodiment is made of a magnetic metal made from an iron-nickel alloy having a thickness of 0.4 mm and a diameter of 30 mm. A releasing layer is coated on the surface of heating roller 220 for its releasability, the layer being a fluoric resin of 15 μm thickness. As the releasing layer surface, singular or mixture of resin and rubber having good releasability, such as PTFE, PFA, FEP, silicone rubber, and fluoric rubber can be coated.

Shielding plate 221 according to the fourth embodiment is configured so that one end of a plane plate end portion opposes exciting coils 250. Since the size of the heating roller is bigger than the third embodiment, two end portions are not connected together at the rear, and they separately configure two shielding plates.

The fixing apparatus according to the fourth embodiment has the temperature self-control function similar to the third embodiment. The overall heat capacity of the fixing apparatus is smaller than the third embodiment. Further, having shielding plate 221 according to the present invention shortens the warm-up period and reduces the temperature drop in the low temperature environment.

Fifth Embodiment

Figure 14:
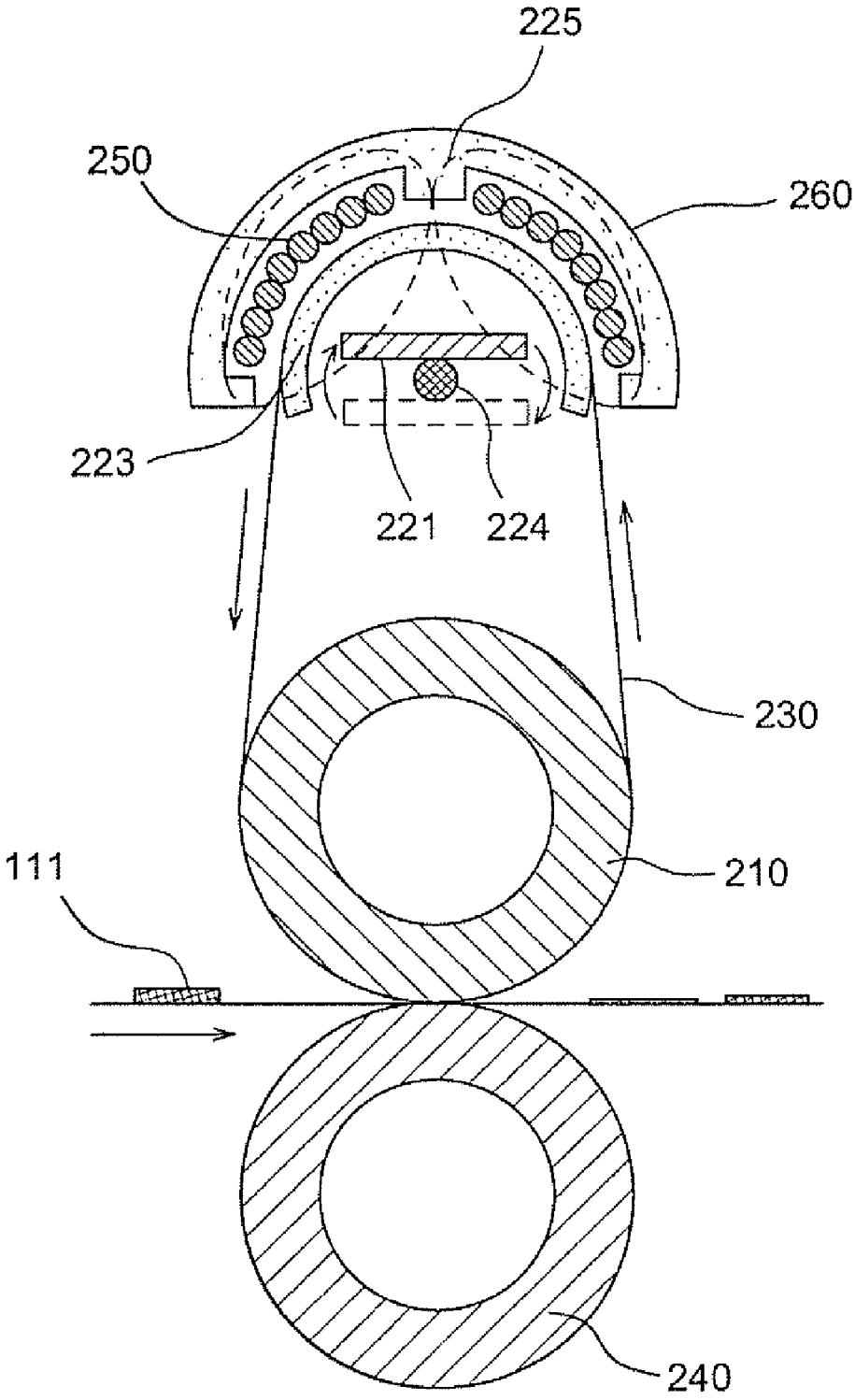
FIG. 14 is a schematic cross sectional view of a fixing apparatus according to the fifth embodiment of the present invention.
Figure 15:
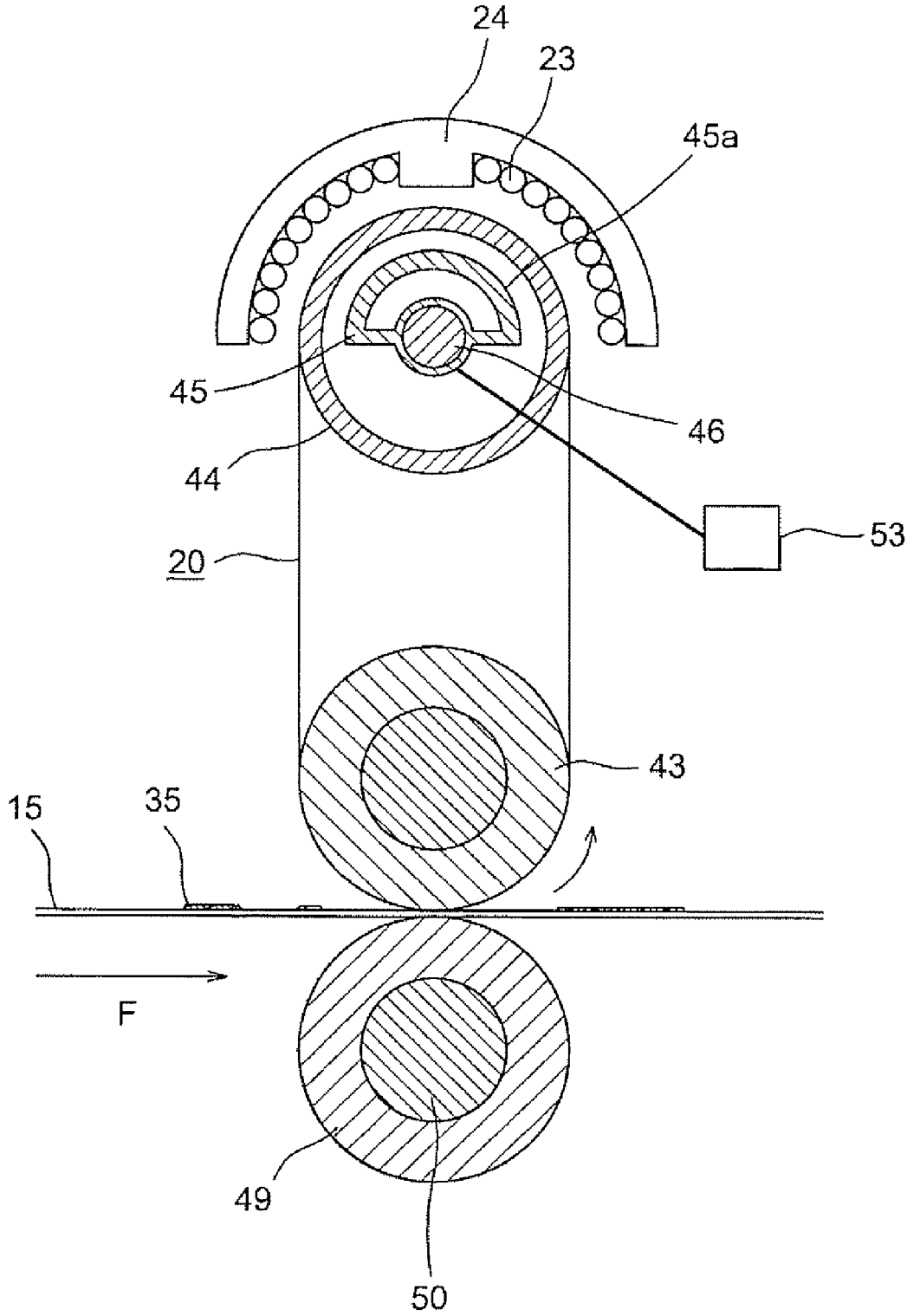
FIG. 15 illustrates conventional art.

FIG. 14 is a schematic cross sectional view of a fixing apparatus according to the fifth embodiment of the present invention. In the fifth embodiment, components having the same configuration with the fixing apparatus according to the first embodiment have the same numerical references and their detailed descriptions are omitted.

In the fifth embodiment, heating roller 220 is eliminated from the first embodiment. Fixing belt 230 is suspended by heating member 223 and fixing roller 210. Other configurations are the same as the first embodiment. Shielding plate 221 is a rectangular plane plate.

Heating plate 223 is made of material similar to the heating roller according to the first embodiment, and has a temperature self-control function. A releasing layer is coated on the surface of heating plate 223 for its releasability, the layer being a fluoric resin of 15 μm thickness. As the releasing layer surface, singular or mixture of resin and rubber having good releasability, such as PTFE, PFA, FEP, silicone rubber, and fluoric rubber can be coated.

In the fixing apparatus according to the fifth embodiment, heating plate 223 has lower heat capacity than heating roller 220 according to the first embodiment. Therefore, the warm-up period is further shortened.

Further, shielding plate 221 according to the fifth embodiment has two positions. The first position (solid line in the figure) shields main magnetic path 225 which is a magnetic flux formed by exciting coils 250, when the temperature of heating plate 223 approaches the Curie point of heating plate 223. The second position (broken line in the figure) does not shield main magnetic path 225. Shielding plate 221 is fixed to center shaft 224 and is moved, along with the rotation of center shaft 224, to be used at the above-described two positions. During the warm-up period, shielding plate 221 is located at the second position (broke line in the figure) that does not shield the main magnetic path. Accordingly, heat does not escape to heating plate 223 during the warm-up period and the initial temperature drop is decreased. Shielding plate 221 then moves to the first position (solid line in the figure), along with the rotation of center shaft 224, that shields main magnetic path 225 of the magnetic flux, and shields main magnetic path 225. Therefore, it is possible to shorten the warm-up period, while maintaining the temperature self-control function, and to decrease the temperature drop during the low temperature environment.

In the above-described first through fifth embodiments, the shielding plate has approximately a reentrant, μ, M or plane shape in the cross sectional view, However, the present invention is not limited to the shapes. The shielding plate can be configured to have approximately V and U shapes in the cross sectional view.

COMPARATIVE EXAMPLE 1

Figure 16:
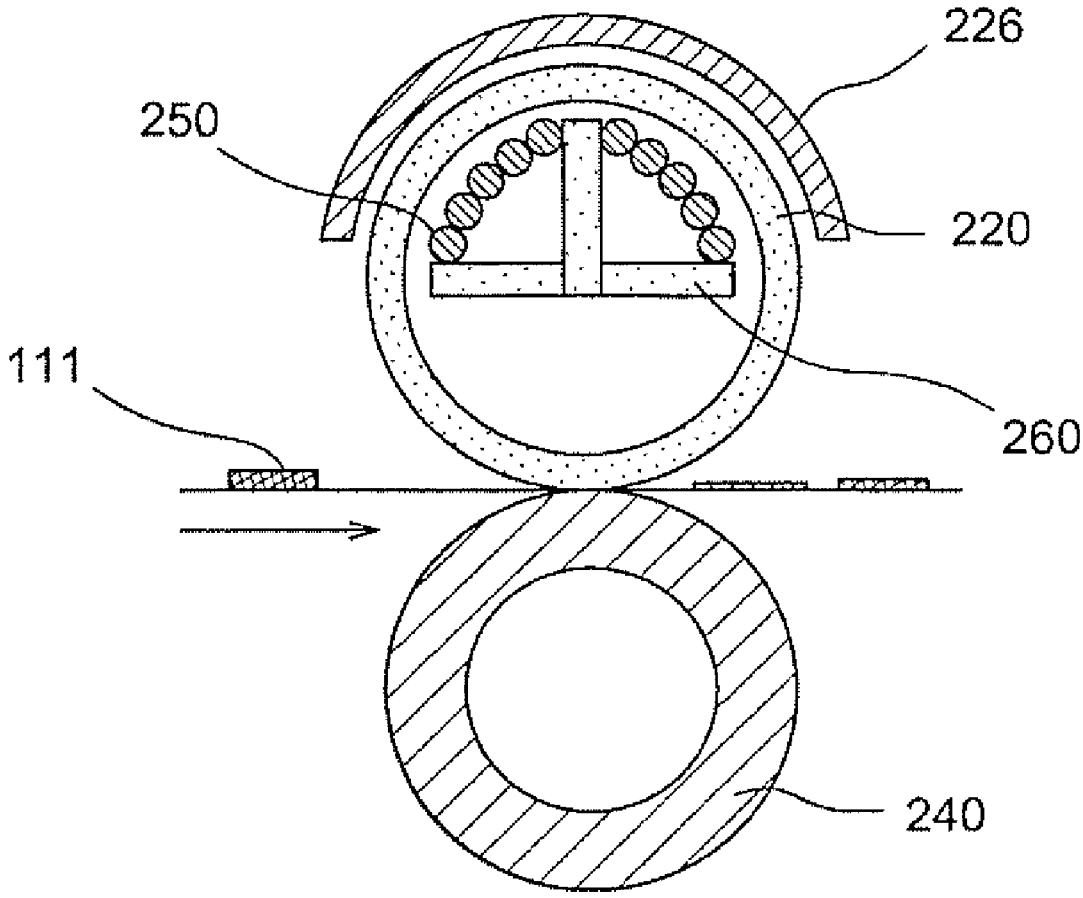
FIG. 16 is a schematic cross sectional view of a fixing apparatus of comparative example 1 in relation to the present invention.

FIG. 16 is a schematic cross sectional view of a fixing apparatus according to comparative example 1. In this comparative example 1, components having the same configuration with the fixing apparatus according to the fourth embodiment have the same numerical references and their detailed descriptions are omitted.

In the comparative example 1, the end portions of shielding plate 221 do not oppose the coils. Arch shaped shielding plate 226 that corresponds to external peripheral of heating roller 220 is provided outside of heating roller 220. Except its different shape, shielding plate 226 is made of material similar to shielding plate 221 of the fourth embodiment. The belt temperature of fixing apparatus according to the comparative example 1, during its warm-up and printing periods, was measured. As a result, the warm-up period was longer and the temperature drop was increased during the low temperature environment, compared to the fourth embodiment, since shielding plate 226 is provided in the proximity of and opposing heating roller 220.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2005-350373 filed on Dec. 5, 2005, entire content of which is expressly incorporated by reference herein.

What is claimed is:

1. A fixing apparatus comprising:

a heat generator comprising a magnetic material;

an exciting coil that is positioned in proximity to said heat generator;

a magnetic core that is positioned in proximity to said exciting coil; and a non-magnetic conductor that has a generally linear cross-sectional configuration, said non-magnetic conductor and said exciting coil being positioned on opposite sides of said heat generator;

wherein said conductor is located in magnetic field generated by said exciting coil and said magnetic core, a cross-section of said conductor comprising the central portion, and a portion projecting from a central portion, the projecting portion of said conductor extending towards the heat generator and having a surface extending transverse to a major surface of the central portion, said transversely extending surface facing said heat generator.

2. The fixing apparatus according to claim 1, wherein said heat generator comprises a roller, said exciting coil being positioned outside said heat generator and said non-magnetic conductor being positioned inside said heat generator.

3. The fixing apparatus according to claim 1, wherein said heat generator comprises a roller, said exciting coil being positioned inside said heat generator, and said non-magnetic conductor being positioned outside said heat generator.

4. The fixing apparatus according to claim 1, further comprising:

a fixing roller;

an endless fixing belt that is mounted about said heat generator and said fixing roller; and a nip roller that, together with said fixing roller, defines a nip through which said fixing belt passes;

wherein said heat generator comprises a roller and an unfixed image on a recording material being fixed when the recording material passes between said fixing belt and said nip roller.

5. The fixing apparatus according to claim 1, wherein said heat generator comprises a non-rotatable member having a substantially semi-circular cross-sectional shape.

6. The fixing apparatus according to claim 4, wherein said fixing belt comprises a conductive layer that is heated through magnetic induction by said exciting coil.

7. The fixing apparatus according to claim 1, wherein said heat generator comprises an endless fixing belt having a releasing layer on a surface thereof.

8. The fixing apparatus according to claim 1, wherein a thickness of said conductor is between about 0.2 mm and 2. mm.

9. The fixing apparatus according to claim 1, said central portion comprising an arcuate portion with said traversely extending surface extending transversely to a major surface of the arcuate portion.

10. The fixing apparatus according to clam 1, said central portion comprising a planer portion with said transversely extending surface extending transversely to the planer portion.

11. The fixing apparatus according to claim 1, said central portion comprising a generally U-shaped portion with said transversely extending surface extending from the ends of the U-shaped portion.

12. The fixing apparatus according to claim 1, said projecting portion extending closer to the heat generator than any other portion of the conductor.

13. The fixing apparatus according to claim 1, said central portion comprising a planer portion with said projecting portion extending co-linearly with said central portion, said transversely extending surface extending transversely to said planer portion.

14. The fixing apparatus according to claim 1, wherein said transversely extending surface comprises end surfaces of said non-magnetic conductor.

15. The fixing apparatus according to claim 1, said non-magnetic conductor being movably mounted between first and second positions.

16. An image forming apparatus comprising;

a photosensitive drum;

an exposer that exposes said photosensitive drum to light to form electrostatic latent on the photosensitive image;

a developer that develops the electrostatic image on the photosensitive drum and a fixing apparatus that fixes the developed image on a recording medium, said fixing apparatus comprising:

a heat generator comprising a magnetic material;

an exciting coil that is positioned in proximity to said heat generator;

a magnetic core that is positioned in proximity to said exciting coil; and a non-magnetic conductor that has a generally linear cross-sectional configuration, said non-magnetic conductor and said exciting coil being positioned on opposite sides of said heat generator;

wherein said conductor is located in magnetic field generated by said exciting coil and said magnetic core, a cross-section of said conductor comprising a central portion, and a portion projecting from the central portion, the projecting portion of said conductor extending towards the heat generator and having a surface extending transverse to a major surface of the central portion, said transversely extending surface facing said heat generator.

17. The image forming apparatus according to claim 16, wherein said heat generator comprises a roller, said exciting coil is positioned outside said heat generator, and said non-magnetic conductor is positioned inside said heat generator.

18. The fixing apparatus according to claim 16, wherein said heat generator comprises a roller, said exciting coil being positioned inside said heat generator, and said non-magnetic conductor being positioned outside said heat generator.

19. The fixing apparatus according to claim 16, said central portion comprising an arcuate portion with said traversely extending surface extending transversely to a major surface of the arcuate portion.

20. A fixing apparatus comprising:

a heat generator comprising a magnetic material;

an exciting coil that is positioned in proximity to said heat generator;

a magnetic core that is positioned in proximity to said exciting coil; and a non-magnetic conductor that has a generally linear cross-sectional configuration, said non-magnetic conductor and said exciting coil being positioned on opposite sides of said heat generator;

wherein said non-magnetic conductor comprises a plurality of conductor elements, each conductor element having a surface extending transverse to a major surface of each respective conductor element, each said extending surface facing said heat generator and extending closer to the heat generator than any other portion of the respective conductor element.

* * * * *